US006678648B1

(12) United States Patent
Surucu

(10) Patent No.: US 6,678,648 B1
(45) Date of Patent: Jan. 13, 2004

(54) FAST LOOP ITERATION AND BITSTREAM FORMATTING METHOD FOR MPEG AUDIO ENCODING

(75) Inventor: Fahri Surucu, Fremont, CA (US)

(73) Assignee: Intervideo, Inc., Wilmington, DE (US)

( * ) Notice: Subject to any disclaimer, the term of this patent is extended or adjusted under 35 U.S.C. 154(b) by 726 days.

(21) Appl. No.: 09/595,391

(22) Filed: Jun. 14, 2000

(51) Int. Cl.[7] ..... G10L 19/00
(52) U.S. Cl. ..... 704/200.1; 704/500; 704/503
(58) Field of Search ..... 704/200.1, 500, 704/501, 502, 503, 504, 229

(56) References Cited

U.S. PATENT DOCUMENTS

| | | | | |
|---|---|---|---|---|
| 5,227,788 A | | 7/1993 | Johnston et al. | |
| 5,341,457 A | | 8/1994 | Hall, II et al. | |
| 5,535,300 A | | 7/1996 | Hall, II et al. | |
| 5,559,722 A | | 9/1996 | Nickerson | |
| 5,663,725 A | | 9/1997 | Jang | |
| 5,748,121 A | | 5/1998 | Romriell | |
| 5,809,474 A | * | 9/1998 | Park | 704/503 |
| 5,848,195 A | | 12/1998 | Romriell | |
| 5,864,802 A | * | 1/1999 | Kim et al. | 704/230 |
| 5,923,376 A | | 7/1999 | Pullen et al. | |
| 5,956,674 A | | 9/1999 | Smyth et al. | |
| 5,974,380 A | | 10/1999 | Smyth et al. | |
| 5,978,762 A | | 11/1999 | Smyth et al. | |
| 6,223,192 B1 | | 4/2001 | Oberman et al. | |
| 6,256,653 B1 | | 7/2001 | Juffa et al. | |
| 6,295,009 B1 | * | 9/2001 | Goto | 341/50 |
| 6,300,888 B1 | | 10/2001 | Chen et al. | |
| 6,542,863 B1 | * | 4/2003 | Surucu | 704/200.1 |
| 6,601,032 B1 | * | 7/2003 | Surucu | 704/500 |

OTHER PUBLICATIONS

Moving Pictures Expert Group, "Coding of Moving Pictures and Associated Audio or Digital Storage Media at up to About 1.5 MBIT/s, Part 3 Audio" 3–11171 rev 1.

Moving Pictures Expert Group, "Coding of Moving Pictures and Associated Audio or Digital Storage Media at up to About 1.5 MBIT/s, Part 3 Audio" ISO/IEC 11172–3:1993(E).

* cited by examiner

*Primary Examiner*—Susan McFadden
(74) *Attorney, Agent, or Firm*—Reed Smith Crosby Heafey; Doyle B. Johnson

(57) ABSTRACT

In an MPEG audio encoder, a sign and an absolute value calculation are performed outside of the quantization inner loop, thereby reducing redundant calculations. The stored sign and absolute values can also be used in the frame packing block, also increasing processing efficiency. Thus, the present invention improves the performance of an MPEG audio encoder.

7 Claims, 7 Drawing Sheets

FAST LOOP ITERATION AND BITSTREAM FORMATTING METHOD FOR MPEG AUDIO ENCODING

This patent application is related to U.S. patent application Ser. No. 09/595,389, entitled "A FAST CODEBOOK SEARCH METHOD FOR MPEG AUDIO ENCODING" filed Jun. 14, 2000; and to U.S. patent application Ser. No, 09/595,387, entitled "A FAST CODE LENGTH SEARCH METHOD FOR MPEG AUDIO ENCODING" filed Jun. 14, 2000, the disclosures of which are herein incorporated by reference.

BACKGROUND OF THE INVENTION

1. Field of the Invention

The present invention relates generally to the field of audio encoding, and more particularly to a fast loop iteration and bitstream formatting method, wherein the method is especially suited for MPEG-compliant audio encoding.

2. Description of the Related Art

In general, an audio encoder processes a digital audio signal and produces a compressed bit stream suitable for storage. A standard method for audio encoding and decoding is specified by "CODING OF MOVING PICTURES AND ASSOCIATED AUDIO OR DIGITAL STORAGE MEDIA AT UP TO ABOUT 1.5 MBIT/s, Part 3 Audio" (3-11171 rev 1), submitted for approval to ISO-IEC/JTC1 SC29, and prepared by SC29/WG11, also known as MPEG (Moving Pictures Expert Group). This draft version was adopted with some modifications as ISO/IEC 11172-3:1993(E) (hereinafter "MPEG-1 Audio Encoding"). The disclosure of these MPEG-1 Audio Encoding standard specifications are herein incorporated by reference. This standard is also often referred to as "MP3" or "MP3 audio encoding." The exact encoder algorithm is not standardized, and a compliant system may use various means for encoding such as estimation of the auditory masking threshold, quantization, and scaling. However, the encoder output must be such that a decoder conforming to the MPEG-1 standard will produce audio suitable for an intended application.

As shown in FIG. 1, input audio samples are fed into the encoder 2. The mapping stage 4 creates a filtered and sub-sampled representation of the input audio stream. The mapped samples may be called either sub-band samples (as in Layer I, see below) or transformed sub-band samples (as in Layer III). A psychoacoustic model 10 creates a set of data to control the quantizer and coding block 6. The data supplied by the psychoacoustic model 10 may vary depending on the actual coder implementation 6. One possibility is to use an estimation of a masking threshold to do this quantizer control. The quantizer and coding block 6 creates a set of coding symbols from the mapped input samples. Again, the actual implementation of the quantizer and coder block 6 can depend on the encoding system. The frame packing block 8 assembles the actual bit stream from the output data of the other blocks, and adds other information (e.g. error correction) if necessary.

In general, as shown in FIG. 3, each quantized data frame 30 contains 576 data samples. Each frame 30 is divided into three sub-regions 32, 34, 36, with each region containing an even number of data samples, and with at least one region further divided in sub-regions. Adjacent data samples 38, or "data pairs" are used as X, Y coordinates into a Huffman codebook, which provides a single code value for each data pair, as illustrated in FIG. 4. A codebook is a table containing bit codes for encoding the data pairs and a code length value.

For certain regions, the data may be encoded in groups of four (quadruples) instead of pairs. The MPEG-1 standard uses 32 different codebooks, of which two or three are candidates for each sub-region, depending on the maximum data value in each sub- region. The "optimal" codebook for each sub-region is the single codebook from among the candidate codebooks that uses the fewest number of total bits to code the entire sub-region.

Depending on the application, different layers of the coding system having increasing encoder complexity and performance can be used. An ISO MPEG Audio Layer N decoder is able to decode bit stream data which has been encoded in Layer N and all layers below N, as described below:

Layer I:

This layer contains the basic mapping of the digital audio input into 32 sub-bands, fixed segmentation to format the data into blocks, a psychoacoustic model to determine the adaptive bit allocation, and quantization using block companding and formatting.

Layer II:

This layer provides additional coding of bit allocation, scale factors and samples, and a different framing is used.

Layer III:

This layer introduces increased frequency resolution based on a hybrid filter bank. It adds a different (non-uniform) quantizer, adaptive segmentation and entropy coding of the quantized values.

Joint stereo coding can be added as an additional feature to any of the layers.

A decoder 12 accepts the compressed audio bit stream, decodes the data elements, and uses the information to produce digital audio output, as shown in FIG. 2. The bit stream data is fed into the decoder 12. Then, the bit stream unpacking and decoding block 14 performs error detection, if error-checking has been applied by the encoder 2. The bit stream data is unpacked to recover the various pieces of information. The reconstruction block 16 reconstructs the quantized version of the set of mapped samples. The inverse mapping block 18 transforms these mapped samples back into uniform PCM (pulse code modulation).

As originally envisioned by the drafters of the MPEG audio encoder specification, the encoder would be implemented in hardware. Hardware implementations provide dedicated processing, but generally have limited available memory. For software MPEG encoding and decoding implementations, such as software programs running on Intel Pentium™ class microprocessors, the need for greater processing efficiency has arisen, while the memory restrictions are less critical. Specifically, in prior art solutions, it is inefficient to repeatedly calculate the absolute values of the samples within an inner iteration loop.

SUMMARY OF THE INVENTION

In general, the present invention performs a sign and an absolute value calculation outside of the quantization inner loop, thereby reducing redundant calculations. The stored sign and absolute values can also be used in the frame packing block, also increasing processing efficiency. Thus, the present invention improves the performance of an MPEG encoder. The method of the present invention may be incorporated into the a standard MPEG audio encoder in order to improve the processing efficiency of the encoder.

BRIEF DESCRIPTION OF THE DRAWINGS

The present invention will be readily understood by the following detailed description in conjunction with the accompanying drawings, wherein like reference numerals designate like structural elements, and in which.

DETAILED DESCRIPTION OF THE INVENTION

The following description is provided to enable any person skilled in the art to make and use the invention and sets forth the best modes contemplated by the inventor for carrying out the invention. Various modifications, however, will remain readily apparent to those skilled in the art, since the basic principles of the present invention have been defined herein specifically to provide fast loop iteration and bitstream formatting method, which is especially suited for MPEG-compliant audio encoding. Any and all such modifications, equivalents and alternatives are intended to fall within the spirit and scope of the present invention.

In standard MPEG-1 Layer III audio encoding, optimal choices of quantization step size and scale factors are obtained by using an iterative technique. In general, a Layer III encoder uses noise allocation. The encoder iteratively varies the quantizers in an orderly way, and quantizes the spectral values. The number of Huffman code bits required to code the audio data are counted, and the resulting noise is determined. If, after quantization, there are still scalefactor bands with more than the allowed distortion (as calculated from the psycho-acoustic model), the encoder amplifies the values in those scalefactor bands and effectively decreases the quantizer step for those bands. The process repeats until either:

1. None of the scalefactor bands have more than the allowed distortion;
2. The next iteration would cause the amplification for any of the bands to exceed the maximum allowed value; or
3. The next iteration would require all the scalefactor bands to be amplified.

Figure 5:
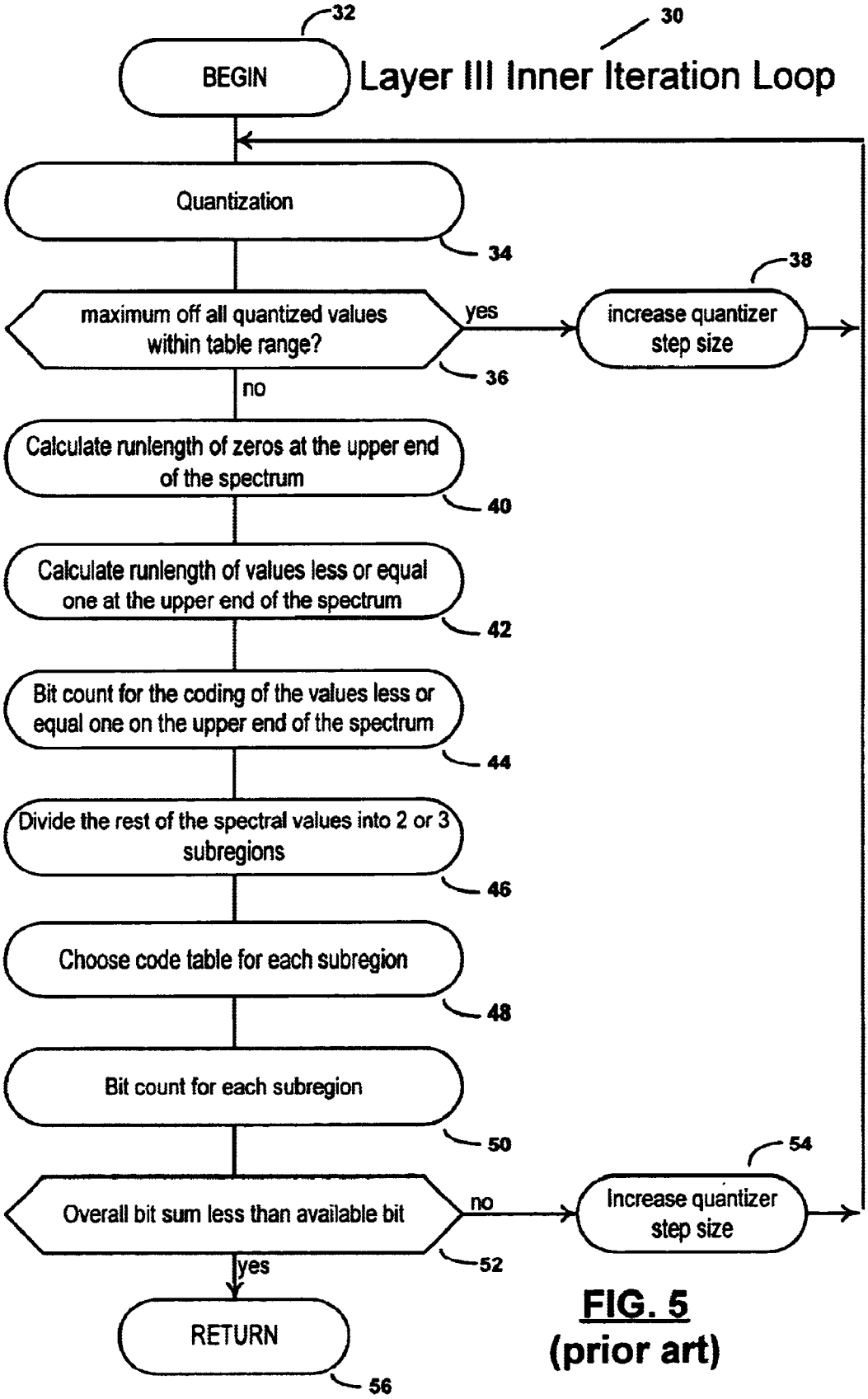
FIG. 5 (prior art)
FIG. 5 is a flowchart of the inner iteration loop for ISO MPEG-1 Layer III audio encoding.

The above described procedure is known as the "inner iteration loop" for Layer III encoding. FIG. 5 illustrates a flowchart 30 of the "inner iteration loop" for ISO MPEG-1 Layer III audio encoding, as disclosed in the specification document. In order to appreciate the context of the present invention, the flowchart 30 of FIG. 5 will now be described. The flow begins at step 32 and the data is quantized at step 34. If the maximum of all quantized values is within range, then the quantizer step size is increased at step 38, and then the data is re-quantized at step 34. Otherwise, a runlength of zeros at the upper end of the spectrum is counted at step 40. Ordinarily, the upper end of the spectrum contains a string of zeros, and instead of actually using a codebook, it is more efficient to just count the number of zeros. The zeros are then coded as a "runlength" value (i.e. 20 zeros). Similarly, at the upper end of the spectrum there is usually a string of data samples whose values are less than or equal to one (i.e. −1, 0, or +1). At step 42, the runlength for the number of values less than or equal to one is calculated. The actual coded data includes a sign bit, however, and so at step 44 the number of sign bits needed are calculated and added to the code length, in order to produce a total bit count value.

The remaining spectral values are then divided into two or three sub-regions at step 46. For each sub-region there are either two or three candidate codebooks that may be used. The optimal codebook from among the candidate codebooks is selected for each sub-region at step 48. The codelengths for the three sub-regions are summed at step 50. Then the total codelength for the entire frame is calculated at step 52 and the size is compared to a limit. If the codelength is too long, the quantizer step size is increased and the procedure repeats back to the quantization step 34, otherwise the loop returns (step 56).

For each granule and channel (left, right) there are 576 spectral values to be coded using Huffman codebooks. These spectral regions are initially divided into three regions:

Zeros Region: The spectral values at the high frequencies tend to have very small values and usually many of them are zero. The "zeros region" (starting from the highest frequency), in which all the spectral values are identical to zero, is not coded at all, but is compressed using runlength compression.

Ones Region: After the "zeros region" toward the low frequencies the spectral values become non-zero and can be at most +/−8191. Before the spectral values get very large, however, there is usually a region of spectral values which are only −1, 0, or 1. This region is called the "ones region" and the values are encoded by either Huffman codebook A or Huffman codebook B. The values are coded as groups of four samples (quadruples), as defined by the MPEG Audio Encoding specification.

Big Values Region: Finally, the rest of the spectral range is called the big values region, which contains at least one spectral value with magnitude larger than one. These values are coded as groups of two (pairs). There are only 29 Huffman codebooks used to encode this region. The Big Values region, depending on the actual audio signal, is divided into either 2 or 3 sub regions and each sub region is encoded with different Huffman codebooks. There are three possible sub region settings (which identify the sub region boundaries in terms of spectral frequency).

As shown in FIG. 5, the quantization step 34 may be performed many times within each inner iteration loop. The quantizer step 34 computes the quantized values according to the following equation:

$$ix(i) = nint\left(\left(\frac{|xr(i)|}{2^{(Qquant + Qquantf)/4}}\right)^{0.75} - 0.0946\right)$$

Figure 6:
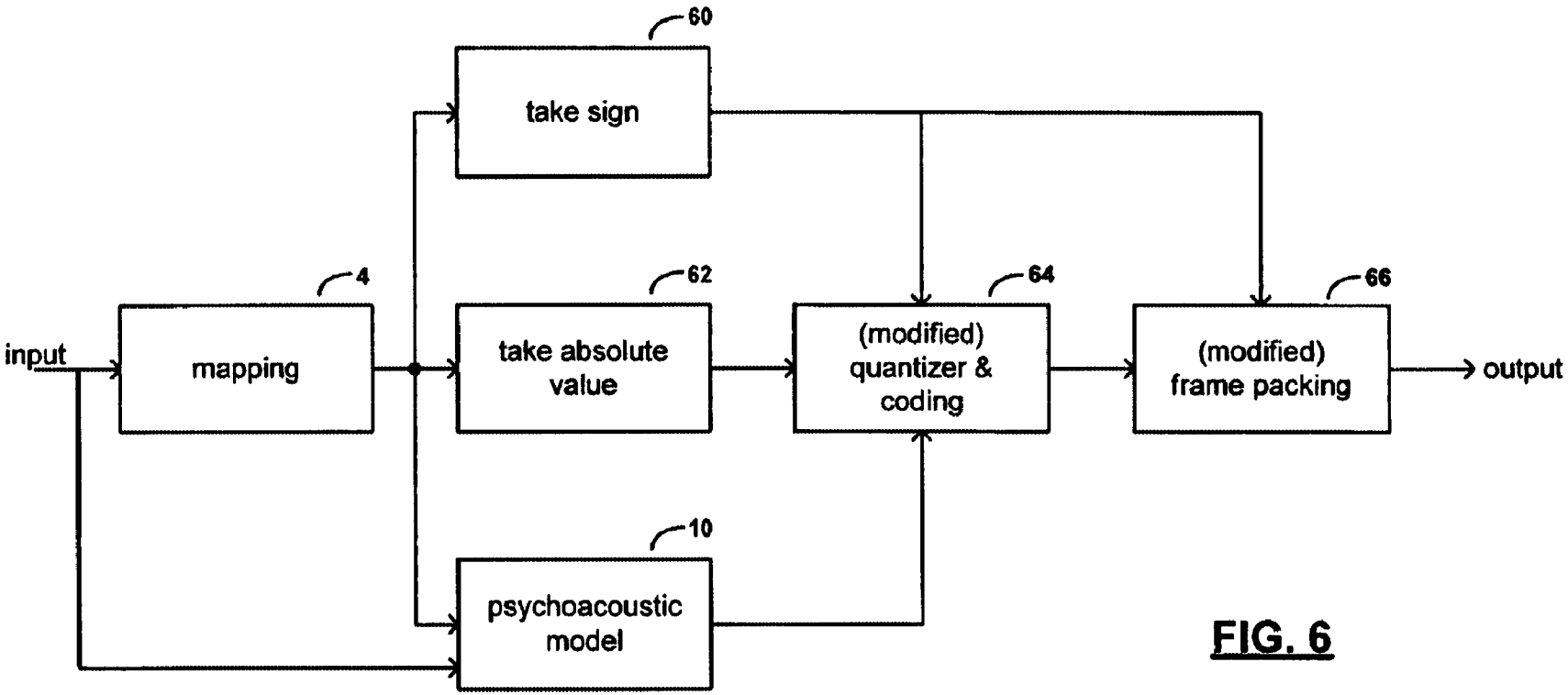
FIG. 6 is a block diagram of one embodiment of the present invention.

This equation calculates the absolute value of the sub-band samples (i.e. $|xr(i)|$) each time this step is performed, which is very inefficient. According to the present invention, the absolute value calculation is performed outside of the inner loop, thereby saving this calculation step each time. As shown in FIG. 6, the sign and absolute values are determined at blocks 60 and 62, respectively, before the quantizer and coding block 64 (which contains the inner loop of FIG. 5).

The take sign block 60 outputs a "0" if the input is greater than or equal to zero, or a "1" if the input is less than zero. These sign values are stored in an array for later recall. The take absolute value block 62 outputs the input, if the input is greater than or equal to zero, and outputs the negative of the input (−input) if the input is less than zero. The absolute values are then stored in an array.

Figure 7:
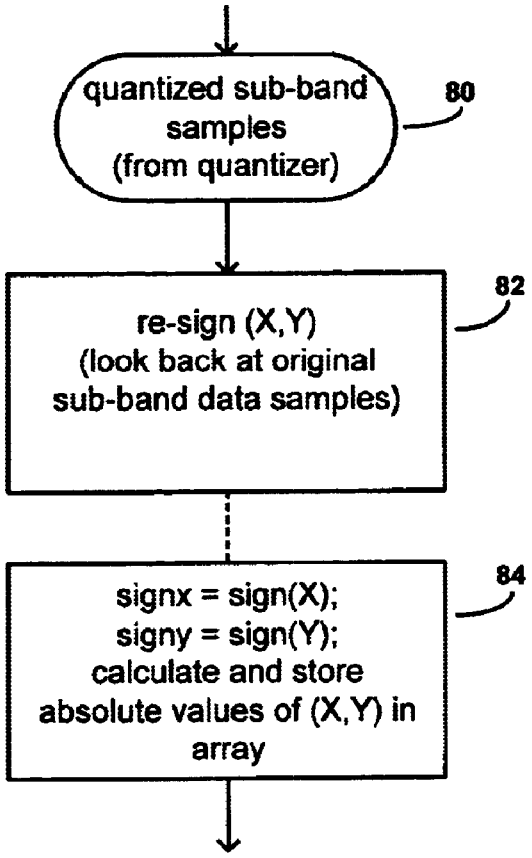
FIG. 7 (prior art)
FIG. 7 is a flowchart illustrating prior art approach to calculating the sign and absolute values in the frame packing block.
Figure 8:
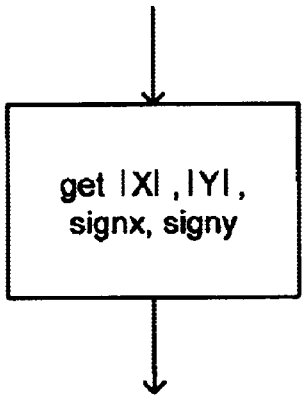
FIG. 8 illustrates the operation of a frame packing block incorporating the present invention.

Since the sign and absolute value calculations are performed before the quantizer 64 and frame packing 66, these blocks are modified as well. Specifically, the quantization step 34 no longer performs the absolute value calculation, but simply recalls the value from memory (i.e. from an array). Similarly, steps 46 and 50, which in the prior art perform absolute value calculations, simply read the values from memory. The frame packing block 66 also no longer needs to perform any absolute value calculations. According to the prior art, as shown in FIG. 7, the quantizer 6 outputs quantized sub-band samples to the frame packing block 8 (step 80). The frame packing block 8, in turn, must look back at the original sub-band data samples in order to determine the sign of the data (step 82). Later in the processing sequence, a sign calculation and absolute value finction are performed (step 84). Thus, the prior art performs redundant calculations involving both the sign of the samples, and the absolute value calculation. According to the present invention, as shown in FIG. 8, since both the sign and absolute value calculations were performed previously, and the values stored in memory (i.e. in separate arrays), these values are simply recalled as needed. Thus, removing the absolute value calculations from within the inner loop improves the performance of both the quantizer and frame packing blocks.

Figure 1:
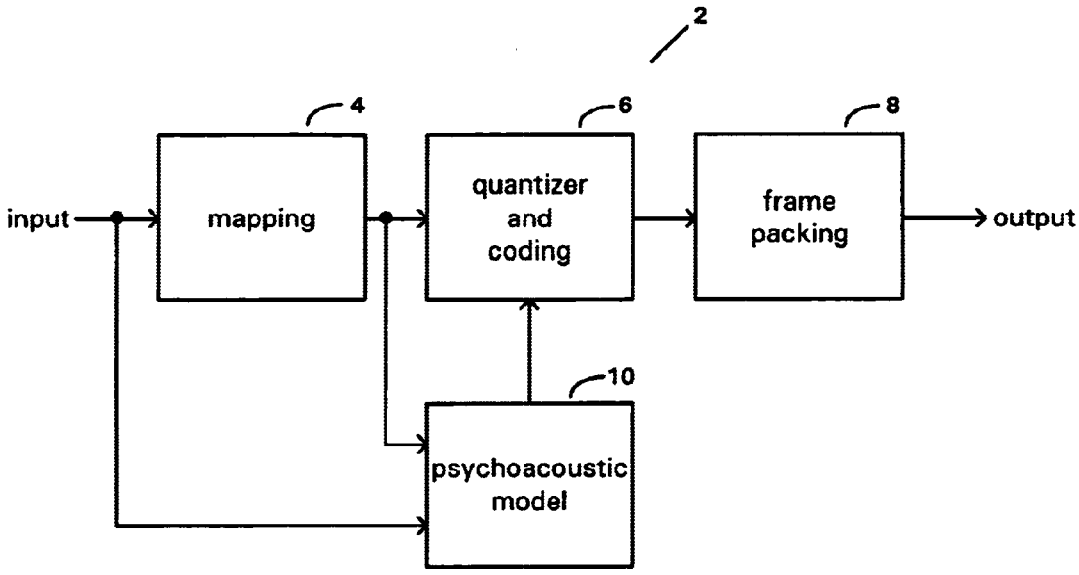
FIG. 1 is a block diagram of an audio encoder.
Figure 2:
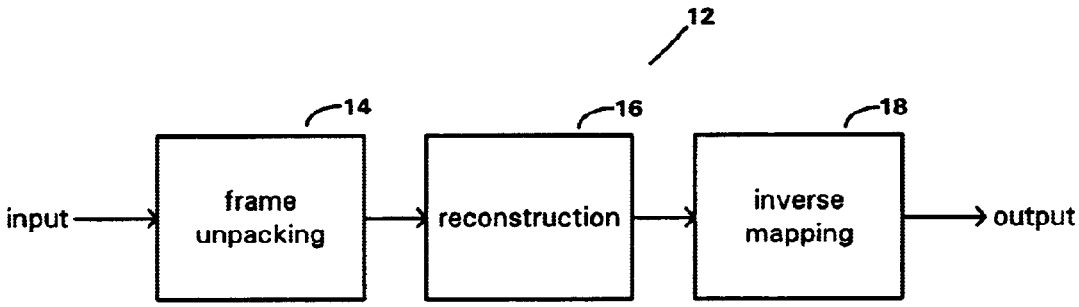
FIG. 2 is a block diagram of an audio decoder.
Figure 3:
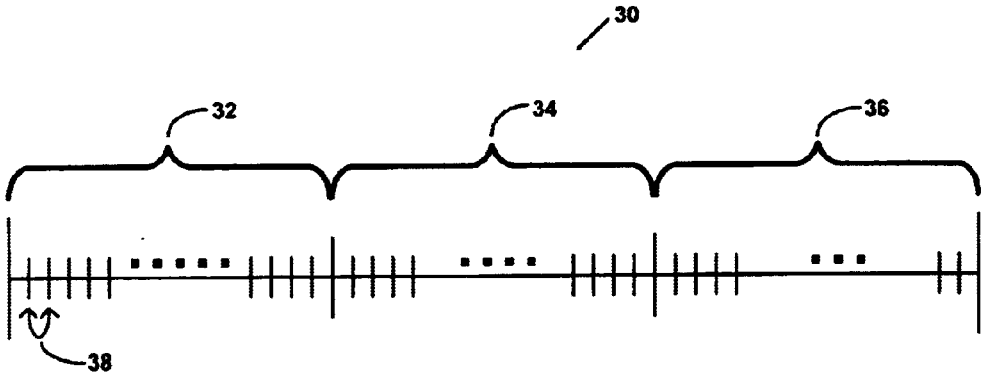
FIG. 3 is a diagram illustrating three subregions within a frame.
Figure 4:
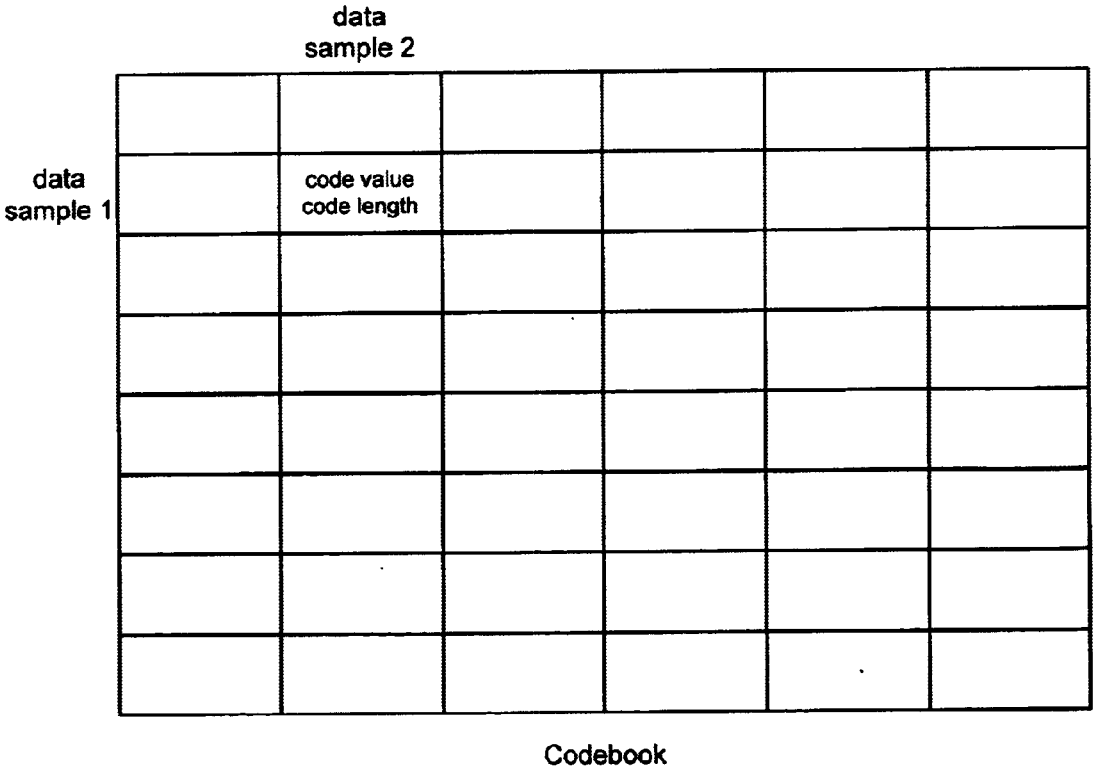
FIG. 4 is an example of a codebook.
Figure 9:
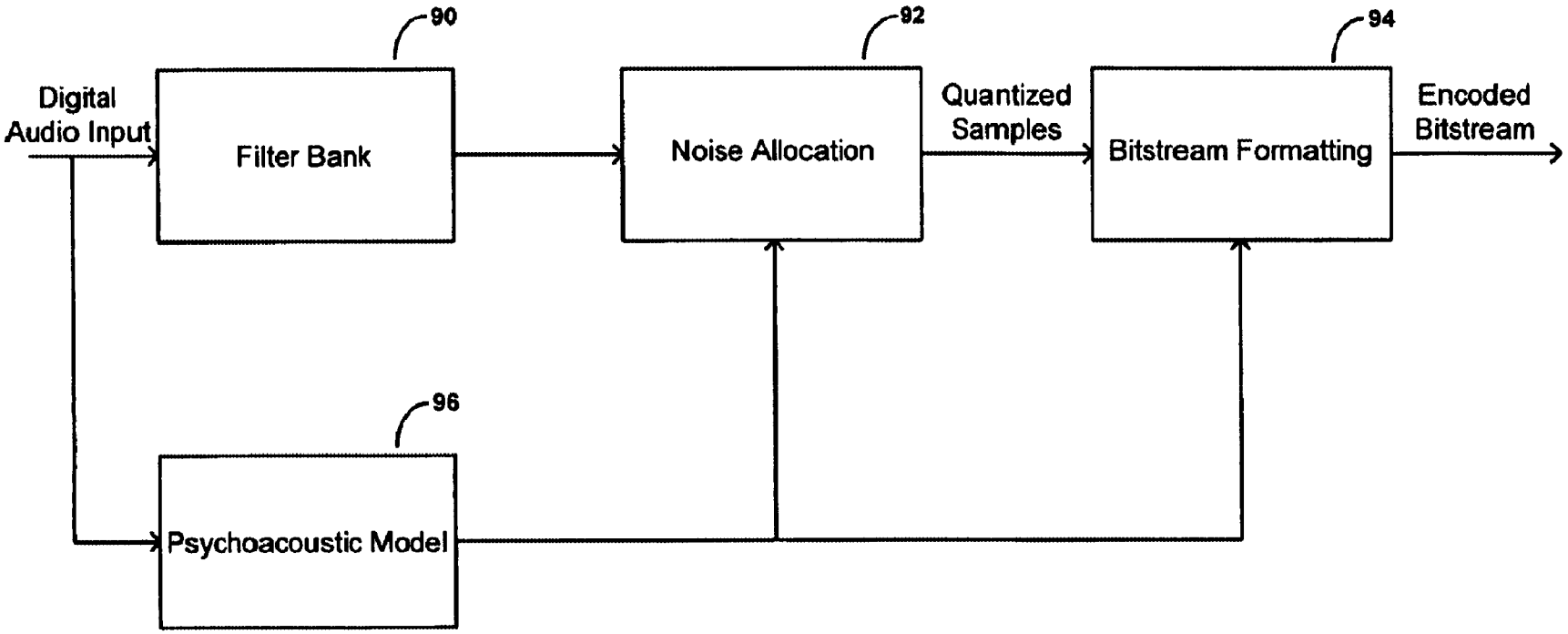
FIG. 9 (prior art)
FIG. 9 is a block diagram of a prior art encoder as shown in FIG. 1, using an alternate naming convention for the blocks.
Figure 10:
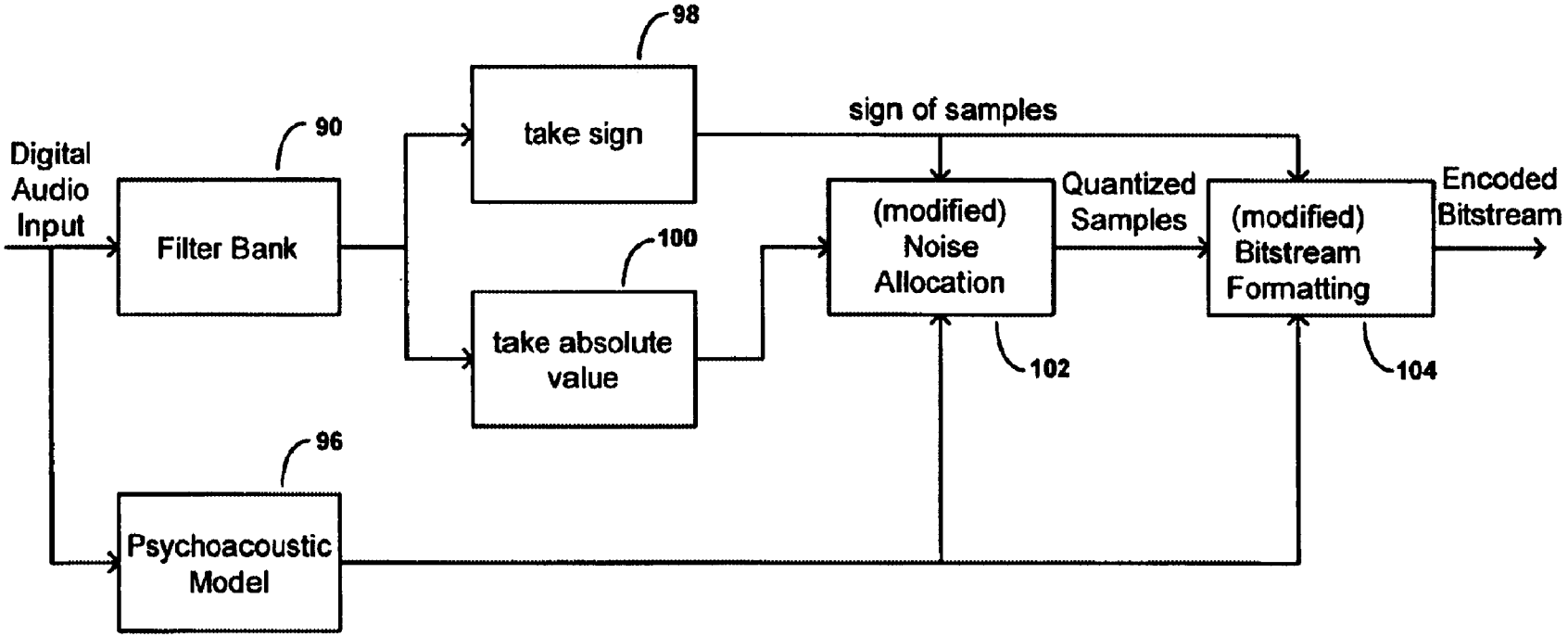
FIG. 10 is a block diagram of the present invention using blocks named according to the alternate naming convention.

FIG. 9 illustrates the encoder of FIG. 1, in which an alternate block naming convention is used. The present invention may be applied to this alternative embodiment as shown in FIG. 10. Two additional blocks, a take sign block 98 and a take absolute value block 100, are added to the encoder before the noise allocation block 102. The noise allocation block 102 and bitstream formatting block 104 are modified as described above (with reference to the quantization and coding block and the frame packing block) to take advantage of the previously calculated and stored signs and absolute values.

Thus, since the present invention performs absolute value calculations outside of the inner loop and stores the values of X and Y, the processing efficiency is improved for MPEG audio encoding, especially in cases where the inner loop iterations are performed several times. The method of the present invention may be incorporated into a standard MPEG audio encoder in order to improve the processing efficiency of the encoder.

Those skilled in the art will appreciate that various adaptations and modifications of the just-described embodiments can be configured without departing from the scope and spirit of the invention. Therefore, it is to be understood that, within the scope of the appended claims, the invention may be practiced other than as specifically described herein.

What is claimed is:

1. A method for computing quantized and coded values of sub-band data samples, the method comprising:

calculating and storing sign values of data samples;

calculating and storing absolute values of the data samples; and performing an inner loop iterative quantization and coding process using the calculated and stored sign and absolute values.

2. The method of claim 1, wherein the method is performed in an MPEG audio encoder implemented in software.

3. The method of claim 1, further comprising:

performing frame packing on the quantized and coded data samples using the calculated and stored sign and absolute values.

4. In an MPEG audio encoder, a method for improving the efficiency of data encoding, the method comprising:

calculating and storing sign values of data samples;

calculating and storing absolute values of the data samples;

performing an inner loop iterative quantization and coding process using the calculated and stored sign and absolute values; and performing frame packing on the quantized and coded data samples using the calculated and stored sign and absolute values.

5. The method of claim 4, wherein the MPEG audio encoder is implemented in software.

6. A method for MPEG compliant data encoding, the method comprising:

mapping input data samples;

calculating and storing sign values of the mapped data samples;

calculating and storing absolute values of the mapped data samples;

processing the input data samples and mapped data samples using a psychoacoustic model;

performing an inner loop iterative quantization and coding process using the calculated and stored sign and absolute values, and the output of the psychoacoustic model; and performing frame packing on the quantized and coded data samples using the calculated and stored sign and absolute values.

7. An MPEG audio encoder comprising:

a mapping block that receives input data;

a sign calculation block that receives output from the mapping block;

an absolute value calculation block that receives output from the mapping block;

a psychoacoustic model block that receives input data and output from the mapping block;

a quantizer and coding block that receives output from the sign calculation block, the absolute value calculation block, and the psychoacoustic model block; and a frame packing block that receives output from the sign calculation block and the quantizer and coding block.

* * * * *